United States Patent [19]

Sweeney et al.

[11] Patent Number: 4,842,307

[45] Date of Patent: Jun. 27, 1989

[54] WELLHEAD LOAD SUPPORTING SYSTEM

[75] Inventors: Thomas F. Sweeney, Newbury Park, Calif.; Philippe C. Nobileau, Paris, France; Charles E. Jennings, Houston, Tex.

[73] Assignee: Vetco Gray Inc., Houston, Tex.

[21] Appl. No.: 197,922

[22] Filed: May 24, 1988

[51] Int. Cl.[4] ..... E21B 33/047; F16L 3/12; F16L 7/00

[52] U.S. Cl. ..... 285/140; 285/133.2

[58] Field of Search ..... 166/86, 88, 89, 96, 166/208; 285/140, 141, 142, 143, 133.2, 133.1

[56] References Cited

U.S. PATENT DOCUMENTS

| | | | |
|---|---|---|---|
| 2,034,698 | 3/1936 | Hild | 285/142 |
| 2,230,421 | 2/1941 | Works | 166/76 |
| 3,062,565 | 11/1962 | Word, Jr. | 285/140 X |
| 3,080,180 | 3/1963 | Rector | 285/137 |
| 3,105,552 | 10/1963 | Haeber et al. | 166/75.1 |
| 3,190,354 | 6/1965 | Stone | 166/89 X |
| 3,209,829 | 10/1965 | Haeber | 166/89 X |
| 3,268,242 | 8/1966 | Bishop et al. | 166/89 X |
| 3,354,962 | 11/1967 | Pierce, Jr. | 166/89 |
| 3,405,956 | 10/1968 | Pierce, Jr. | 285/141 X |
| 3,871,449 | 3/1975 | Ahlstone | 285/140 X |
| 4,109,942 | 8/1978 | Morrill | 285/140 |

OTHER PUBLICATIONS

"Mathematical Modelling of 15 M Subsea Wellheads" 9/24/82.

*Primary Examiner*—Stephen J. Novosad
*Attorney, Agent, or Firm*—James E. Bradley

[57] ABSTRACT

A wellhead housing has features to increase the load carrying capabilities. The wellhead housing has a inclined load shoulder. A lower casing hanger which supports the outer string of casing is supported on the load shoulder. A landing profile locates between the load shoulder and the casing hanger. The landing ring has a cylindrical portion both above and below the load shoulder. These cylindrical portions restrain the material of the wellhead housing from yielding downward and inward. Also, a support ring encircles the wellhead housing on the exterior radially outward from the load shoulder. The support ring is fitted to the wellhead housing in an interference fit to provide a preload compressive force. Additional casing hangers for intermediate and inner strings are supported on the lower casing hanger.

8 Claims, 3 Drawing Sheets

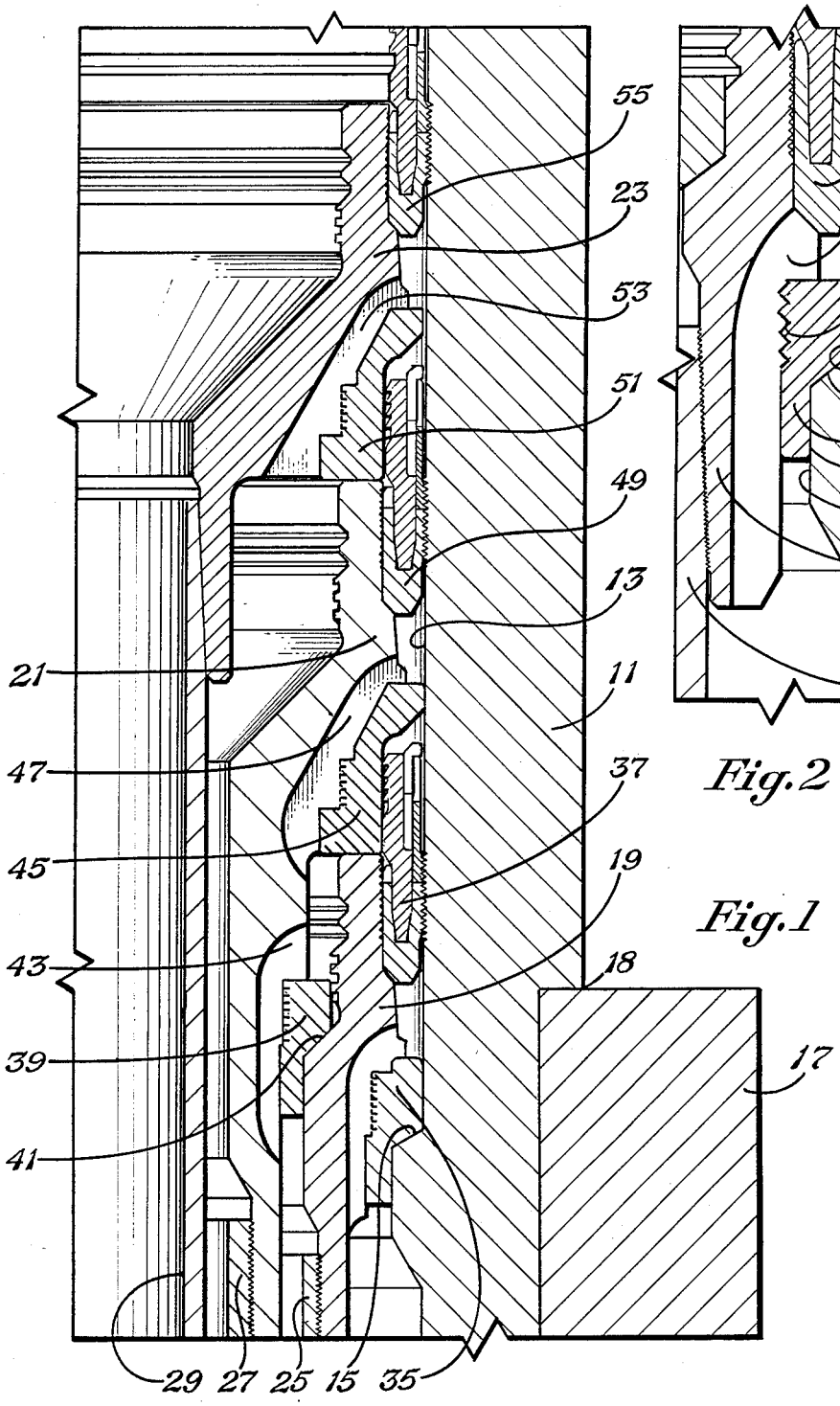
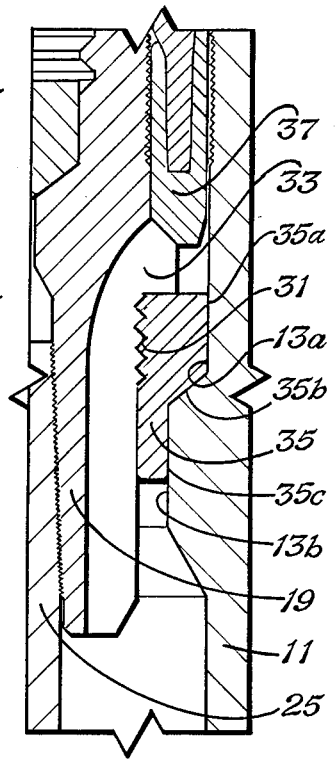
Fig. 2
Fig. 1

WELLHEAD LOAD SUPPORTING SYSTEM

BACKGROUND OF THE INVENTION

1. Field of the Invention

This invention relates in general to oil and gas wellheads, and in particular to means for suspending multiple casing strings in a well.

2. Description of the Prior Art

In an oil and gas well, a wellhead or wellhead housing will be located at the ground surface. The wellhead housing is a tubular member having an axial bore. A conical load shoulder is located in the bore.

If the well is a deep well, normally there will be more than one string of casing extending into the well. The first string of casing is connected to a casing hanger which lands on the load shoulder in the wellhead housing. Cement is pumped down the string of casing and back up the annulus surrounding the casing to cement the casing in the well. The return of fluid from the casing passes through bypass or return flow passages on the side of the casing hanger. After the cementing is completed, a packoff is sealed between the casing hanger and the wellhead housing.

The well will then be drilled to a greater depth at a smaller diameter. The second string of casing may also extend completely to the wellhead housing and be supported by a casing hanger. In one technique, the second casing hanger is stacked on top of the first or lower casing hanger. The weight of the smaller diameter casing is transmitted through the lower casing hanger to the wellhead housing load shoulder. The second string of casing will also be cemented in place. A packoff will be sealed between the second casing hanger and the wellhead housing bore. In some wells, a third string of casing will also be run and supported by a casing hanger stacked on top of the first two casing hangers.

The load or landing shoulder in the wellhead housing must be very strong. It must be able to support the weight of the multiple strings of casing. Also, high pressure in the wellhead acts on the casing hangers, exerting a high force on the load shoulder.

For this reason, if the pressures will be very high and the casing weight is very high, mechanisms are employed to transfer the weight separately from each casing hanger directly to the wellhead, rather than to the single load shoulder. While this is workable, it results in considerable extra expense. The load mechanisms are expensive. Also, these devices require more length for the wellhead housing, therefore increasing the cost for this item.

SUMMARY OF THE INVENTION

In this invention, the capacity of the conical load shoulder in the wellhead housing is increased sufficiently so that casing hangers can be stacked on one another even in cases of very high pressure and casing weight. A landing ring or profile is located between the lowest casing hanger and a conical shoulder. The landing ring has an upper cylindrical portion that tightly engages the bore of the wellhead housing just above the conical shoulder. The landing ring has a lower cylindrical portion that tightly engages the bore just below the conical shoulder.

An exterior load support ring is located on the outside of the well housing, radially outward from the landing ring. The exterior ring is a large annular member. Preferably, it fits on the wellhead with an interference fit so that it applies a preload compressive stress in the wellhead housing.

When the lower casing hanger is under load, the stress area around the internal load shoulder will have a downward and outward force component normal to the conical shoulder. Also, components of force will transmit through the upper and lower cylindrical portions of the landing ring to the wellhead housing. These radial outward forces are opposed by the radial inward forces from the support ring. There is also an upward tensile force due to pressure in the wellhead. The forces tend to act against each other, increasing the ability of the conical shoulder to resist yielding.

DESCRIPTION OF THE DRAWING

FIG. 1 is a partial vertical sectional view illustrating part of a wellhead constructed in accordance with this invention.

FIG. 2 is an enlarged sectional view of a portion of the wellhead of FIG. 1.

DESCRIPTION OF THE PREFERRED EMBODIMENT

Figure 3:
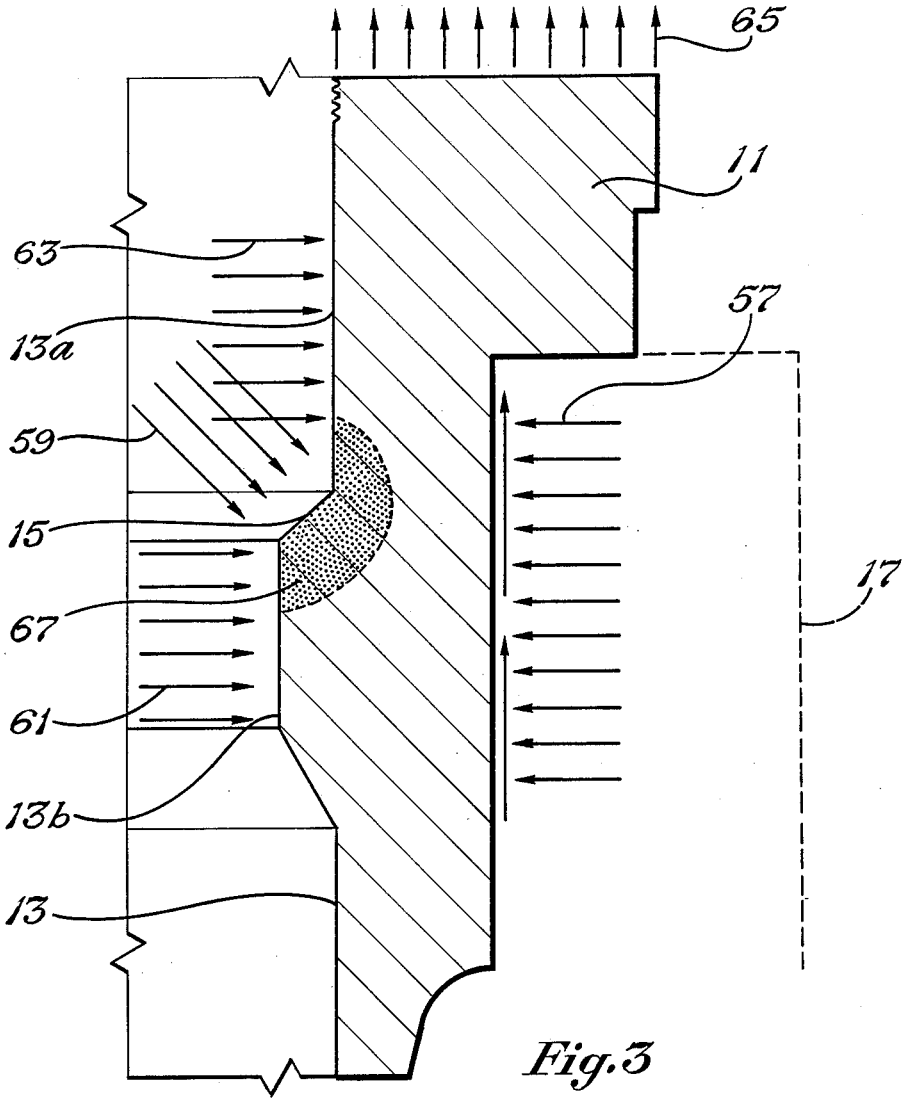
FIG. 3 is a schematic view illustrating the forces occurring in the wellhead of FIG. 1.

Referring to FIG. 1, wellhead housing 11 is a tubular member located at the top of a well. Wellhead housing 11 has an axial bore 13. An upward facing conical load shoulder 15 is located in the bore. A cylindrical portion 13*a* is located directly above the load shoulder 15. A cylindrical portion 13*b* is located directly below the load shoulder 15. The load shoulder 15 is at an angle of about 55 degrees relative to the axis of the bore 13, but this can vary.

A support ring 17 is mounted to the exterior of the wellhead housing 11. The support ring 1 is located radially outward from the load shoulder 15. The support ring 17 is a large annular member extending below the load shoulder 15 some distance. In the preferred embodiment, the support ring 17 fits under a shoulder 18 on the exterior of the wellhead housing 11. Shoulder 18 is above the load shoulder 15 a short distance. The support ring 17 may be supported on additional structure (not shown), which in the case of a subsea well would be a guide base. In that case, downward load on the wellhead housing 11 will transmit through the shoulder 18 to the support ring 17 and to the additional supporting structure.

Preferably, the support ring 17 has an inner diameter that is initially slightly smaller than the outer diameter of the wellhead housing 11, such as about 0.040 inch. This creates an interference fit. When the support ring 17 is forced on the wellhead housing 11, it will exert a preload compressive force in a radially inward direction. The support ring 17 may be installed by heating it, forcing it on the wellhead housing 11 while hot, then allowing it to cool.

A lower casing hanger 19 is supported in the bore 13 of the wellhead housing 11. An intermediate casing hanger 21 extends into and is supported on the lower casing hanger 19. An upper casing hanger 23 extends into and is supported on the intermediate casing hanger 21. The lower casing hanger 19 is secured to a string of outer casing 25 that extends into the well. The intermediate casing hanger 21 is secured to a string of intermediate diameter casing 27, that extends into the outer casing 25. The upper casing hanger 23 is secured to a string of inner casing 29 that extends through the intermediate casing 27.

Referring to FIG. 2, the lower casing hanger 19 has a set of external threads 31. The threads 31 are located approximately halfway between the upper and lower ends of the lower casing hanger 19. A plurality of vertical channels 33 extends through threads 31. The channels 33 extend from the lower end of the lower casing hanger 19 to a point above the threads 31. The channels 33 serve as bypass or return flow passages for the return of fluid when cement is pumped down the outer casing 25.

A landing profile comprising a landing ring 35 has internal threads secured to the threads 31. Landing ring 35 is a solid metal ring rigidly secured to the lower casing hanger 19. Preferably, landing ring 35 is of a material harder than the body of the wellhead housing 11 and also than the body of the lower casing hanger 19. Typically, the lower casing hanger 19 and the wellhead housing 11 would have a yield strength of about 80,000 pounds per square inch, while the landing ring 35 would have a yield strength about 50% percent higher, such as between 100,000 and 120,000 pounds per square inch.

Referring to FIG. 2, the landing ring 35 has an upper cylindrical portion 35*a*, a downward facing conical shoulder 35*b* and a lower cylindrical portion 35*c*. The upper cylindrical portion 35*a* is approximately the same dimension as the wellhead housing bore cylindrical portion 13*a* to provide a tight fit. The landing ring shoulder 35*b* is of the same taper and dimension as the wellhead housing load shoulder 15. The lower cylindrical portion 35*c* is of approximately the same dimension as the bore cylindrical portion 13*b* to provide a tight fit.

A conventional packoff 37 will be positioned and energized between the lower casing hanger 19 and the wellhead housing 11 to form a seal. The packoff 37 is preferably a metal-to-metal seal. It may be of a type such as described in U.S. Pat. No. 4,665,979, Carl F. Boehm, Jr., May 19, 1987.

In the embodiment of FIG. 1, a landing ring 39 supports the intermediate casing hanger 21 on the lower casing hanger 19. Landing ring 39 is similar in shape and material composition to the landing ring 35. Landing ring 39 has a conical shoulder that mates with a shoulder 41 formed in the inner axial passage of the lower casing hanger 19. Shoulder 41 is preferably substantially parallel with the load shoulder 15. A force normal to shoulder 41 also is substantially normal to load shoulder 15.

Landing ring 39 has a lower cylindrical portion that bears against the walls of the axial passage of the lower casing hanger 19. Landing ring 39 is screwed to the intermediate casing hanger 21 by threads. Channels 43 extend vertically from below the threads to above for the return of fluid during cementing.

Another landing ring 45, as shown in FIG. 1, provides additional support for the intermediate casing hanger 21. Landing ring 45 is secured by threads to the intermediate casing hanger 21. The lower end of landing ring 45 bears against the upper end of the lower casing hanger 19. Channels 47 formed in the sidewall of intermediate casing hanger 21 extend from below the landing ring 45 to above for the passage of return fluid.

An upper landing ring 51 supports the upper casing hanger 23 on the intermediate casing hanger 21. Upper landing ring 51 is secured by threads to the exterior of the upper casing hanger 23. Upper landing ring 51 has a lower end that bears against the upper end of the intermediate casing hanger 21. Channels 53 are spaced apart from each other and formed in the sidewall of the upper casing hanger 23. Channels 53 extend from below the upper landing ring 51 to above for the return of fluid. A packoff 55 fits between the upper casing hanger 23 and the wellhead housing 11.

In operation, after the well is drilled to a selected depth, the outer casing 25 will be run. The casing 25 will be supported on the upper end by the lower casing hanger 19. The landing ring 35 will seat on the load shoulder 15. Cement is pumped down the well to return back up the annulus surrounding the outer casing 25. The well fluid displaced by the cement returns through the channels 33 to the surface. The packoff 37 is then placed between the lower casing hanger 19 and the wellhead housing 11 and energized to form a seal.

The well is then drilled to a deeper depth. Intermediate casing 27 is run. The intermediate casing hanger 21 will support the casing 27. The landing ring 39 supports the intermediate casing hanger 21 on the shoulder 41 of the lower casing hanger 19. Cement is pumped down the intermediate casing 27. Fluid displaced by the cement returns through the channels 43 and 47 to the surface. Subsequently, the packoff 49 is placed between the wellhead housing 11 and the intermediate casing hanger 21 and energized.

The well is drilled to the total depth. Then the inner casing 29 is run. The upper casing hanger 23 will be located at the upper end. The load on the upper casing hanger 23 transmits through the upper landing ring 51 to the intermediate casing hanger 21. Cement is pumped down the inner string of casing 29. Fluid displaced by the cement flows through the channels 53 to the surface. Subsequently, packoff 55 is placed between the upper casing hanger 23 and the wellhead housing 11 and energized.

Referring to FIG. 3, the interference fit from the support ring 17 provides a preload compressive force 57 that is directed inward. The loading on the casing hangers 19, 21 and 23 has a force component 59 directed normal to the shoulder 15. The landing ring 35 (FIG. 1) through its lower cylindrical portion 35*c*, provides a force component 61. This force component 61 is directed radially outward in opposition to the preload force 57. The upper cylindrical portion 35*a* (FIG. 1) results in an outward radial force component 63. There will also be an upward tensile force 65 due to the pressure within the wellhead 11 tending to force the structure at the top of the wellhead 11 up.

The landing ring 35 constrains the material locally in the area 67 at the load shoulder 15, restraining yielding movement. The support ring 17 provides compressive hoop stress locally at the load shoulder 15. The stacking of the intermediate casing hanger 21 and upper casing hanger 23 through the landing rings 39, 45 and 51 produces loading normal to the wellhead load shoulder 15. The forces act to reduce the downward yielding of the load shoulder 15 and thus increase its ability to support the load. Also, the downward force on the wellhead housing 11 due to the weight of the casing strings 25, 27 and 29 is supported by shoulder 18 at a point below the load shoulder 15. This reduces the tensile stress in the area of the wellhead housing 11 above the load shoulder 15 over prior art types that support the wellhead housing from a point near its upper end.

Figure 4:
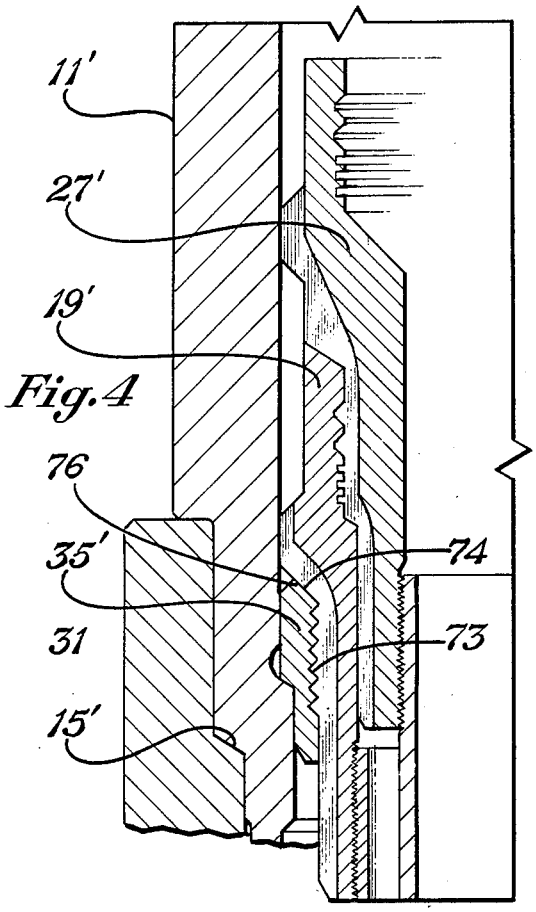
FIG. 4 is a sectional view of a second embodiment of a wellhead load supporting system constructed in accordance with this invention.
Figure 5:
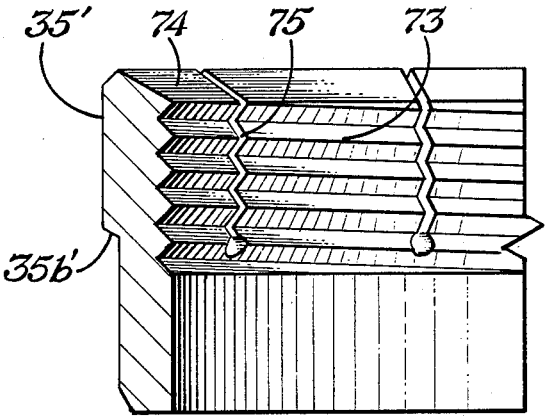
FIG. 5 is an enlarged sectional view of the landing ring for the wellhead load supporting system of FIG. 4.

In the second embodiment, which is shown in FIGS. 4 and 5, the landing ring 35' is secured to the threads 31' of casing hanger 19' by threads 73. Each thread 73 has an upper flank inclining at a 45 degree angle relative to the axis of landing ring 35'. Threads 73 extend lower than the landing shoulder **35*b*'. A plurality of vertical slots 75 extend through the landing ring 35' from the upper edge to a point above the lower end of the threads 73**.

The upper edge 74 of landing ring 35' is tapered, inclining at an angle of 55 degrees relative to the axis of the landing ring 35'. This is the same angle of inclination as the landing shoulder 15'. When under load, the upper edge 74 of landing ring 35' will contact a conical surface 76 formed on the exterior of casing hanger 19' immediately above threads 31. Conical surface 76 inclines at an angle of 55 degrees relative to the axis of casing hanger 19' to mate with the upper edge 74. The landing ring 35' is dimensioned so that initially before loading there will be a slight gap of about 0.020 inch between the upper edge 74 and the conical surface 76.

In the embodiment of FIG. 4, the intermediate casing hanger 27' is supported directly on the lower casing hanger 19'. There is no landing ring similar to the landing ring 39 of FIG. 1.

In the operation of the embodiment of FIGS. 4 and 5, the load will first pass through the landing ring threads 73. A radial component tends to cause the landing ring 35' to expand. The slots 75 let the upper portion of landing ring 35' expand out into the wellhead housing 11'. The expansion of the threaded portion 73 assists in transmitting load radially into the wellhead housing 11'. This reduces the yielding tendency resulting from the load on the load shoulder 15'. Once the landing ring 35' has fully expanded into the cylindrical portions of the wellhead housing 11', the load path shifts and passes through the tapered upper edge 74, through the landing ring 35' and from shoulder **35*b*' into the load shoulder 15'**.

Figure 6:
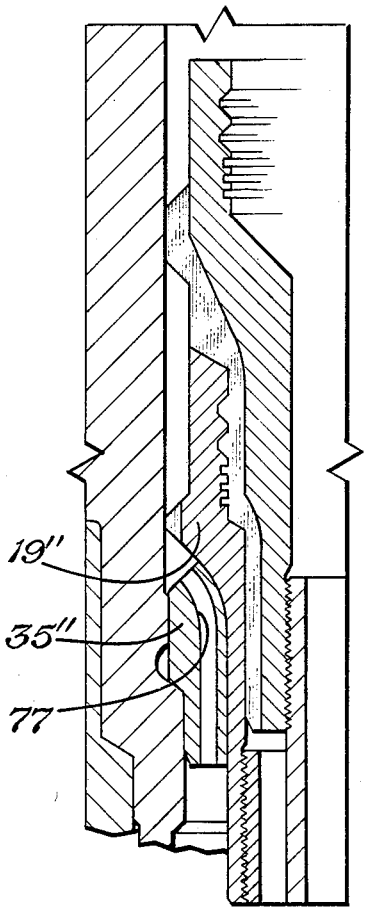
FIG. 6 is a sectional view of a third embodiment of a wellhead load supporting system constructed in accordance with this invention.

In the embodiment of FIG. 6, the landing ring 35'' is secured to the easing hanger 19'' by an interference fit or some means other than by threads. There are no flutes located on the exterior wall of the casing hanger 19'' similar to the flutes 33 of FIG. 1. Rather, the return flow occurs through passages 77 extending through the landing ring 35''.

The invention has significant advantages. A significantly higher load is able to be placed on the internal load shoulder. This enables the casing hangers to be stacked one on another. This reduces the expense and problems of supporting each casing hanger independently on the wellhead housing.

While the invention has been shown in only three of its forms, it should be apparent to those skilled in the art that it is not so limited, but is susceptible to various changes without departing from the scope of the invention.

We claim:

1. In a well having a wellhead housing with a bore, an internal inclined load shoulder located in the bore, an upper cylindrical portion in the bore immediately above the load shoulder and a lower cylindrical portion immediately below the load shoulder in the bore, an improved means for supporting a string of casing in the well, comprising in combination:

a casing hanger having an axial passage, positioned in the wellhead housing and secured to a string of casing extending into the well; and a landing profile rigidly secured to the exterior of the casing hanger, the landing profile having a downward facing inclined shoulder that mates with the load shoulder, the landing profile having an upper cylindrical portion that engages the upper cylindrical portion of the bore, the landing profile having a lower cylindrical portion that engages the lower cylindrical portion of the bore, the landing profile being of a material substantially harder than the material of the casing hanger.

2. In a well having a wellhead housing with a bore, an internal inclined load shoulder located in the bore, an upper cylindrical portion in the bore immediately above the load shoulder and a lower cylindrical portion immediately below the load shoulder in the bore, an improved means for supporting at least two strings of casing in the well, comprising in combination:

a lower casing hanger having an axial passage containing an upward facing inclined shoulder, the lower casing hanger being positioned in the wellhead housing and secured to a string of outer casing extending into the well;

a landing profile on the exterior of the lower casing hanger, the landing profile having a downward facing inclined shoulder that mates with the load shoulder, the landing profile having an upper cylindrical portion that engages the upper cylindrical portion of the bore, the landing profile having a lower cylindrical portion that engages the lower cylindrical portion of the bore, the landing profile being of a material substantially harder than the material of the lower casing hanger and the material of the wellhead housing;

a plurality of return flow passages extending between the wellhead housing and the lower casing hanger separate and radially outward from the axial passage, the return flow passages extending from below to above the landing profile for enabling fluid to return while cement is pumped down the outer casing; and an upper casing hanger concentrically supported on the inclined shoulder of the lower casing hanger and secured to a string of inner casing extending through the outer casing into the well.

3. In a well having a wellhead housing with a bore, an internal inclined load shoulder located in the bore, an upper cylindrical portion in the bore immediately above the load shoulder and a lower cylindrical portion immediately below the load shoulder in the bore, an improved means for supporting at least two strings of casing in the well, comprising in combination:

a lower casing hanger positioned in the wellhead housing and secured to a string of outer casing extending into the well;

a landing profile secured to the exterior of the lower casing hanger, the landing profile having a downward facing inclined shoulder that mates with the load shoulder, the landing profile having an upper cylindrical portion that engages the upper cylindrical portion of the bore, the landing profile having a lower cylindrical portion that engages the lower cylindrical portion of the bore;

an annular support member located on the exterior of the wellhead housing radially outward from the load shoulder for reacting against radial forces transmitted from the casing hanger through the upper and lower cylindrical portions of the landing profile; and an upper casing hanger concentrically supported on the lower casing hanger and secured to a string of inner casing extending through the outer casing into the well.

4. In a well having a wellhead housing with a bore, an internal inclined load shoulder located in the bore, an upper cylindrical portion in the bore immediately above the load shoulder and a lower cylindrical portion immediately below the load shoulder in the bore, an improved means for supporting at least two strings of casing in the well, comprising in combination:

a lower casing hanger positioned in the wellhead housing and secured to a string of outer casing extending into the well, the lower casing hanger having an axial passage containing an upward facing inclined shoulder;

a landing profile on the lower casing hanger, the landing profile having a downward facing inclined shoulder that mates with the load shoulder, the landing profile having an upper cylindrical portion that engages the upper cylindrical portion of the bore, the landing profile having a lower cylindrical portion that engages the lower cylindrical portion of the bore;

a plurality of return flow passages extending between the wellhead housing and the lower casing hanger separate and radially outward from the axial passage, the return flow passages extending from below to above the landing profile for enabling fluid to return while cement is pumped down the outer casing;

an annular support member located on the exterior of the well radially outward from the load shoulder for reacting against radial forces transmitted from the lower casing hanger through the upper and lower cylindrical portions of the landing profile and also for reacting against downward force, the annular support member being secured to the wellhead housing in an interference fit to apply an inward directed radial preload compressive force to the wellhead housing in the vicinity of the load shoulder; and an upper casing hanger secured to a string of inner casing extending through the outer casing into the well, the upper casing hanger being concentrically supported on the inclined shoulder of the lower casing hanger.

5. In a well having a wellhead housing with a bore, an internal inclined load shoulder located in the bore, an upper cylindrical portion in the bore immediately above the load shoulder and a lower cylindrical portion immediately below the load shoulder in the bore, an improved means for supporting at least two strings of casing in the well, comprising in combination:

a lower casing hanger having an axial passage, positioned in the wellhead housing and secured to a string of outer casing extending into the well, the lower casing hanger having a set of exterior threads formed on its exterior;

a landing profile having a set of internal threads secured to the exterior threads of the lower casing hanger, the landing profile having a downward facing inclined shoulder that mates with the load shoulder, the landing profile having an upper cylindrical portion that engages the upper cylindrical portion of the bore, the landing profile having a lower cylindrical portion that engages the lower cylindrical portion of the bore;

a plurality of spaced apart vertical slots extending through the landing profile; and an upper casing hanger concentrically supported on the lower casing hanger and secured to a string of inner casing extending through the outer casing into the well.

6. In a well having a wellhead housing with a bore, an internal inclined load shoulder located in the bore, an upper cylindrical portion in the bore immediately above the load shoulder and a lower cylindrical portion immediately below the load shoulder in the bore, an improved means for supporting at least two strings of casing in the well, comprising in combination:

a lower casing hanger having an axial passage, positioned in the wellhead housing and secured to a string of outer casing extending into the well, the lower casing hanger having a set of exterior threads formed on its exterior;

a landing profile having a set of internal threads secured to the exterior threads of the lower casing hanger, the landing profile having a downward facing inclined shoulder that mates with the load shoulder, the landing profile having an upper cylindrical portion that engages the upper cylindrical portion of the bore, the landing profile having a lower cylindrical portion that engages the lower cylindrical portion of the bore, the landing profile being of a material substantially harder than the material of the lower casing hanger and the material of the wellhead housing;

a plurality of spaced apart vertical slots extending through the landing profile from an upper edge of the landing profile through at least part of the internal threads of the landing profile to a termination point above a lower edge of the landing profile;

a plurality of return flow passages extending through the exterior threads of the lower casing hanger, the return flow passages extending from below to above the landing profile for enabling fluid to return while cement is pumped down the outer casing;

an annular support member located on the exterior of the well radially outward from the load shoulder for reacting against radial forces transmitted from the lower casing hanger through the upper and lower cylindrical portions of the landing profile and also for reacting against downward force, the annular support member being secured to the wellhead housing in an interference fit to apply an inward directed radial preload compressive force to the wellhead housing in the vicinity of the load shoulder; and an upper casing hanger concentrically supported on the lower casing hanger and secured to a string of inner casing extending through the outer casing into the well.

7. In a well having a wellhead housing with a bore, an internal inclined load shoulder located in the bore, an upper cylindrical portion in the bore immediately above the load shoulder and a lower cylindrical portion immediately below the load shoulder in the bore, an improved means for supporting at least two strings of casing in the well, comprising in combination:

a lower casing hanger having an axial passage, positioned in the wellhead housing and secured to a string of outer casing extending into the well;

a landing profile secured to the exterior of the lower casing hanger, the landing profile having a downward facing inclined shoulder that mates with the load shoulder, the landing profile having an upper cylindrical portion that engages the upper cylindrical portion of the bore, the landing profile having a lower cylindrical portion that engages the lower cylindrical portion of the bore, the landing profile being of a material substantially harder than the material of the lower casing hanger and the material of the wellhead housing;

a plurality of return flow passages extending vertically through the landing profile for enabling fluid to pass from below the landing profile to above while cement is pumped down the outer casing; and an upper casing hanger concentrically supported on the lower casing hanger and secured to a string of inner casing extending through the outer casing into the well.

8. In a well having a wellhead housing with a bore, an internal inclined load shoulder located in the bore, an upper cylindrical portion in the bore immediately above the load shoulder and a lower cylindrical portion immediately below the load shoulder in the bore, an improved means for supporting at least two strings of casing in the well, comprising in combination:

a lower casing hanger having an axial passage, positioned in the wellhead housing and secured to a string of outer casing extending into the well, the lower casing hanger having a set of exterior threads formed on its exterior, the lower casing hanger having a tapered surface located immediately above the exterior threads, facing generally downward and outward;

a landing profile having a set of internal threads secured to the exterior threads of the lower casing hanger, the landing profile having a downward facing inclined shoulder that mates with the load shoulder, the landing profile having an upper cylindrical portion that engages the upper cylindrical portion of the bore, the landing profile having a lower cylindrical portion that engages the lower cylindrical portion of the bore, the landing profile having an upper edge that is tapered and mates with the tapered surface of the lower casing hanger;

a plurality of spaced apart vertical slots extending through the landing profile to facilitate expanding the landing profile outward under load into the upper and lower cylindrical portions of the bore to restrain yielding of the load shoulder; and an upper casing hanger concentrically supported on the lower casing hanger and secured to a string of inner casing extending through the outer casing into the well.

* * * * *

UNITED STATES PATENT AND TRADEMARK OFFICE

CERTIFICATE OF CORRECTION

PATENT NO. : 4,842,307

DATED : June 27, 1989

INVENTOR(S) : Thomas F. Sweeney, et al

It is certified that error appears in the above-identified patent and that said Letters Patent is hereby corrected as shown below:

Col. 2, line 45, "1" should be --17--.

Signed and Sealed this

Seventeenth Day of July, 1990

*Attest:*

HARRY F. MANBECK, JR.

*Attesting Officer*

*Commissioner of Patents and Trademarks*

Disclaimer 4,842,307—*Thomas F. Sweeney*, Newbury Park, Calif; *Philippe C. Nobileau*, Paris, France; *Charles E. Jennings*, Houston, Tex. WELLHEAD LOAD SUPPORTING SYSTEM. Patent dated June 27, 1989. Disclaimer filed July 15, 1991, by the assignee, Vetco Gray Inc.

Hereby enters this disclaimer to claims 1 and 2 of said patent.

[*Official Gazette October 29, 1991*]